US005104261A

United States Patent [19]

Anderson et al.

[11] Patent Number: 5,104,261

[45] Date of Patent: Apr. 14, 1992

[54] TUNNEL BORING MACHINE

[75] Inventors: Olov Anderson, Vällingby, Sweden; Helmut Dick, Spiez, Switzerland; Sverker Hartwig, Täby, Sweden

[73] Assignee: Atlas Copco Constructing and Mining Technique AB, Stockholm, Sweden

[21] Appl. No.: 615,467

[22] Filed: Nov. 19, 1990

[30] Foreign Application Priority Data

Nov. 22, 1989 [SE] Sweden ..... 8903919

[51] Int. Cl.[5] ..... E21D 9/00

[52] U.S. Cl. ..... 405/142; 405/141; 405/138

[58] Field of Search ..... 405/141, 138, 142, 145

[56] References Cited

U.S. PATENT DOCUMENTS 4,569,616 2/1986 Takahashi et al. ..... 405/141 X 4,624,605 11/1986 Akesaka ..... 405/141 X 4,804,295 2/1989 Kondo ..... 405/141

*Primary Examiner*—Dennis L. Taylor

*Assistant Examiner*—J. Russell McBee

*Attorney, Agent, or Firm*—Eric Y. Munson; Mark P. Stone

[57] ABSTRACT

Tunnel boring machine for reaming of a pilot tunnel (11). The machine housing (12) is provided with a projecting part in front of the boring head (13), said projecting part comprising a part (20) being fixed relative to the machine housing and a shield (19) being separable from the fixed part.

This arrangement permits substantially uninterrupted excavation of the tunnel and prevents the excavated soil from becoming wedged between the boring head and the tunnel front.

4 Claims, 3 Drawing Sheets

TUNNEL BORING MACHINE

BACKGROUND OF THE INVENTION

The present invention relates to a tunnel boring machine for reaming a pilot tunnel.

When reaming a pilot tunnel the problem may arise that material broken loose may get stuck between the boring head and the tunnel front at the transition between the reamed tunnel and the pilot tunnel, so that the boring work must be interrupted and the blocks broken loose removed.

SUMMARY OF THE INVENTION

The present invention, which is defined in the subsequent claims, aims at solving the above mentioned problem through preventing blocks broken loose from getting stuck between the boring head and the tunnel front.

BRIEF DESCRIPTION OF THE DRAWINGS

An embodiment of the invention is described below with reference to the accompanying drawings in which.

DESCRIPTION OF THE BEST MODES FOR CARRYING OUT THE INVENTION

Figure 1:
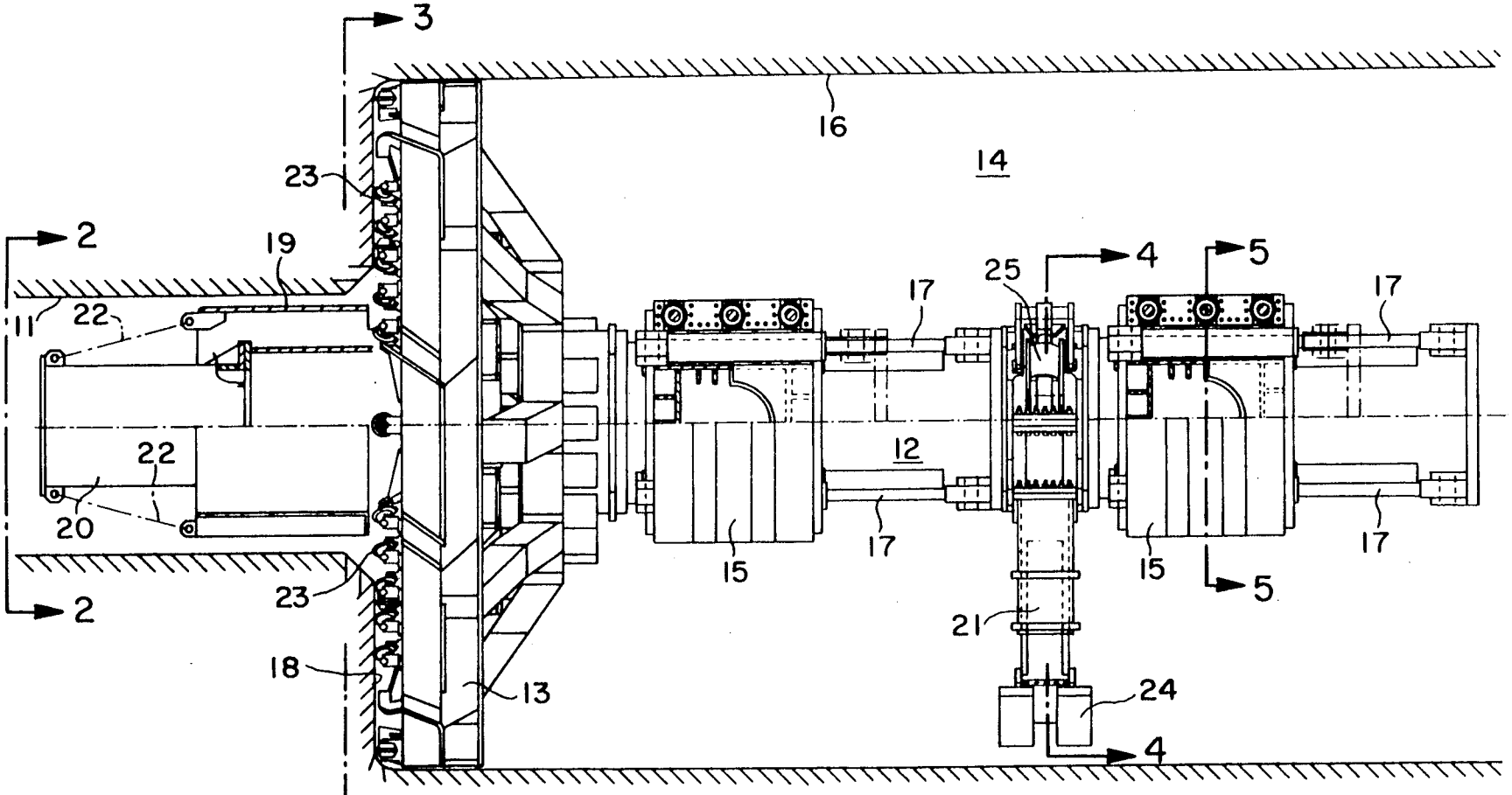
FIG. 1 shows a tunnel boring machine according to the invention from the side partly in section.
Figure 2:
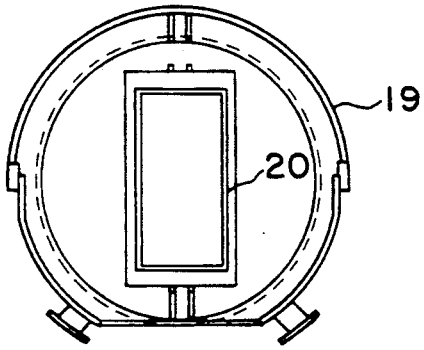
FIG. 2 shows a view according to 2—2 in FIG. 1.
Figure 3:
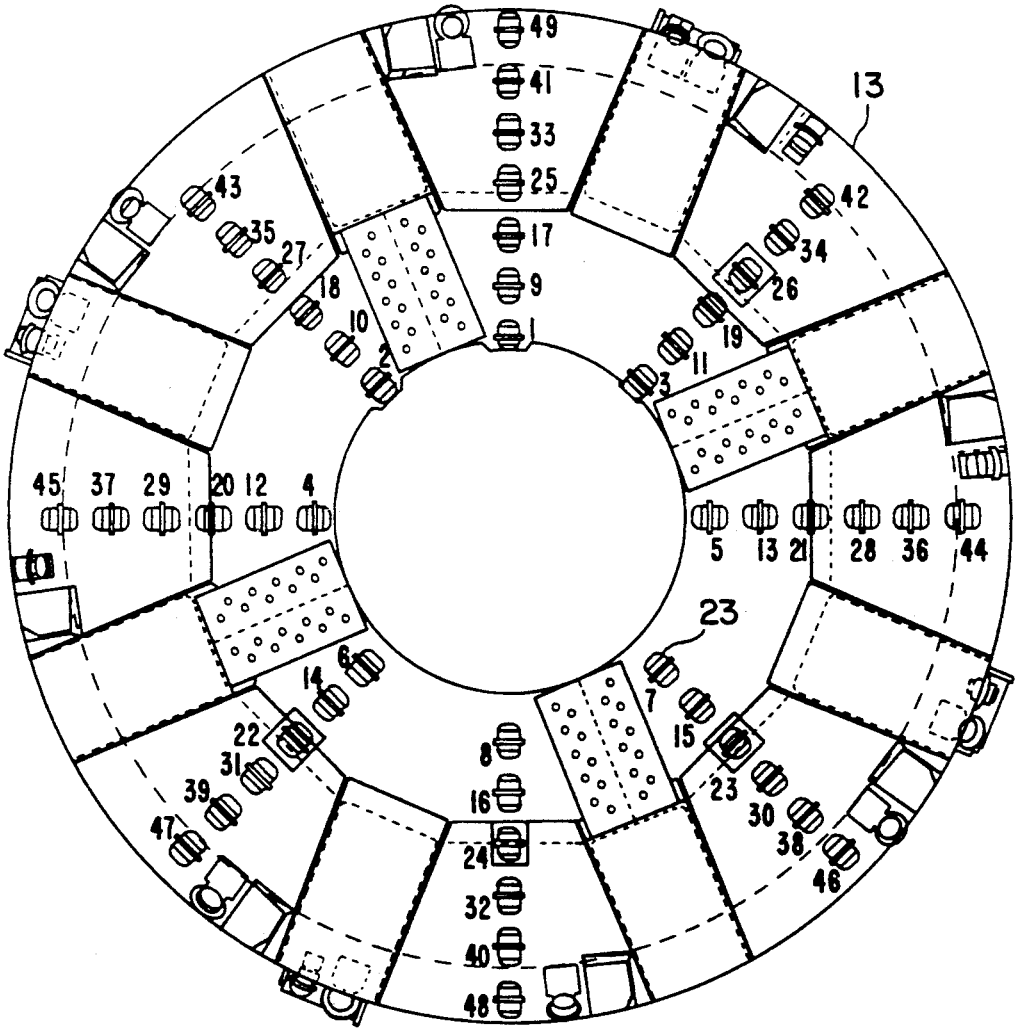
FIG. 3 shows a view according to 3—3 in FIG. 1.

The tunnel boring machine for reaming the pilot tunnel 11 shown in the drawings comprises a machine housing 12. The machine housing is built up from a number of modules through which the machine in a relatively simple way can be rebuilt to be adapted to different requirements in different tunnels. The shown tunnel boring machine is provided with two units provided with clamping shoes 15 for clamping the machine in the tunnel 14. The clamping shoes act against the tunnel wall 16. The clamping shoes are movable relative to machine housing 12 in the longitudinal direction of the tunnel by means of hydraulic cylinders 17. A boring head 13 is rotatably mounted on machine housing 12. The boring head is rotated relative to the machine housing by one or more, not shown, electric motors. Boring head 13 is pressed against tunnel front 18 by means of hydraulic cylinders 17. A unit provided with support legs 21 is mounted between the units with clamping shoes 15. By means of these support legs, comprising hydraulic cylinders, the tunnel boring machine is aligned vertically. The different machine housing parts and the boring head are provided with flanges having standard form so that the different modules can be exchanged without extensive design work. Machine housing 12 is at its front end provided with a projecting part which extends into the pilot tunnel 11. This projecting part comprises a part 20 being fixed relative to the machine housing and a shield 19. Shield 19 is by means of wires or chains 22 connected with fixed part 20. As a result shield 19 is moved into pilot tunnel 11 when tunnel 14 is bored. The purpose of shield 19 is to prevent that blocks broken loose at the transition between tunnel 14 and pilot tunnel 11 fall down and get stuck between boring head 13 and tunnel front 18. Boring head 13 is provided with a number of cutters 23 for crushing of the rock. These cutters are worn and must be exchanged at intervals. For this purpose shield 19 can be separated from the fixed part 20. After separation boring head 13 can be moved backwards to give access to the cutters. Shield 19 then remains as protection at the transition between tunnel 14 and pilot tunnel 11.

Figure 4:
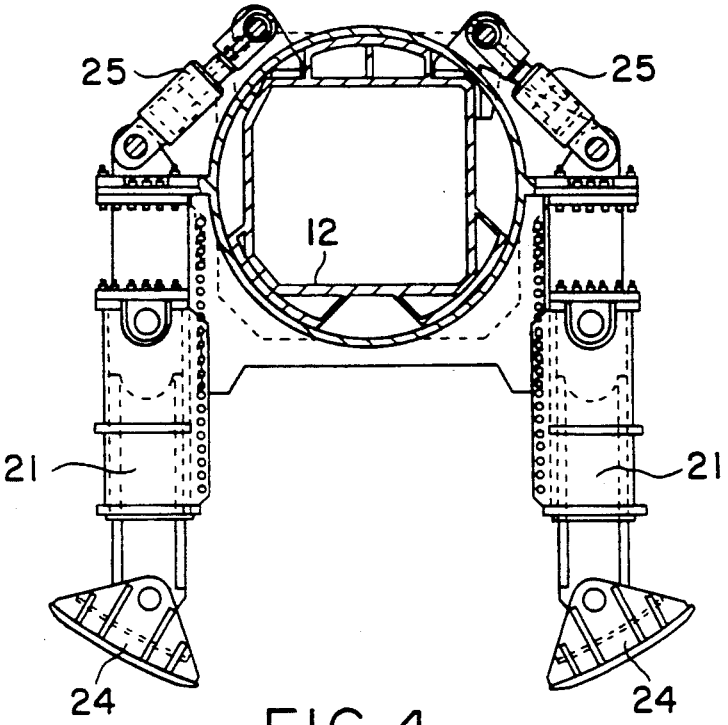
FIG. 4 shows a view according to 4—4 in FIG. 1 partly in section.
Figure 5:
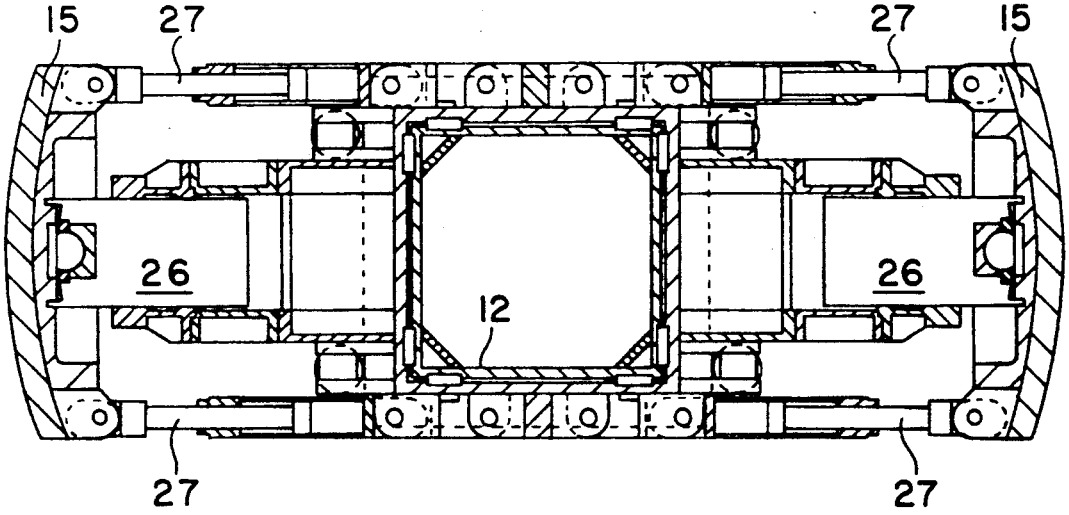
FIG. 5 shows a section according to 5—5 in FIG. 1.

As shown in FIG. 4 support legs 21 are provided with feet 24. Hydraulic cylinders 25 are connected between support legs 21 and machine housing 12. Cylinders 25 make it possible to turn machine housing 12 about the longitudinal axis of the tunnel when clamping shoes 15 are not in engagement with tunnel wall 16. Through this it is possible to counteract the turning which the tunnel boring machine often encounters as a result of reaction forces during the boring.

Horizontal control of the tunnel boring machine is obtained by means of hydraulic cylinders 27 which move the machine housing 12 relative to clamping shoes 15. When the adjustment has been done clamping is obtained by pressurization of pistons 26.

We claim:

1. Tunnel boring machine for substantially uninterrupted reaming of a pilot tunnel, said machine comprising a machine housing, a boring head rotatably mounted relative to the machine housing, a plurality of clamping shoes movable in the longitudinal direction of a tunnel relative to the machine housing for clamping said machine against a tunnel wall, and means for pressing said boring head against a tunnel front, said means for pressing including means arranged between said clamping shoes and said machine housing for displacing the machine housing in the longitudinal direction of the tunnel; said machine housing including means for substantially uninterrupted reaming of said pilot tunnel, said means for substantially uninterrupted reaming comprising a projection part in front of the boring head, said projecting part extending into said pilot tunnel to prevent material broken loose from becoming wedged between the boring head and the tunnel front.

2. Tunnel boring machine according to claim 1, wherein said projecting part comprises a part being fixed relative to the machine housing and a shield being separable from the fixed part.

3. Tunnel boring machine according to claim 1, wherein said machine housing comprises a number of modules.

4. Tunnel boring machine according to claim 2, wherein said machine housing comprises a number of modules.

* * * * *

UNITED STATES PATENT AND TRADEMARK OFFICE

CERTIFICATE OF CORRECTION

PATENT NO. : 5,104,261

DATED : April 14, 1992

INVENTOR(S) : Anderson et al

It is certified that error appears in the above-identified patent and that said Letters Patent is hereby corrected as shown below:

On the title page, item [73] Assingee: please change "Atlas Copco Constructing and Mining Technique AB" to read --Atlas Copco Construction and Mining Technique AB--.

Signed and Sealed this

Twentieth Day of October, 1992

*Attest:*

DOUGLAS B. COMER

*Attesting Officer*

*Acting Commissioner of Patents and Trademarks*